US006526783B2

(12) United States Patent
Sheu

(10) Patent No.: US 6,526,783 B2
(45) Date of Patent: Mar. 4, 2003

(54) DOUBLE-FACED REVERSIBLE COLOR EFFECT WEFT KNIT FABRICS AND METHODS FOR MAKING SAME

(76) Inventor: Pat Sheu, 2 Birchwood Ct., Mineola, NY (US) 11501

( * ) Notice: Subject to any disclaimer, the term of this patent is extended or adjusted under 35 U.S.C. 154(b) by 210 days.

(21) Appl. No.: 09/780,829

(22) Filed: Feb. 9, 2001

(65) Prior Publication Data

US 2002/0111100 A1 Aug. 15, 2002

(51) Int. Cl.[7] ..... D04B 11/04
(52) U.S. Cl. ..... 66/22; 66/196
(58) Field of Search ..... 66/8, 64, 169 R, 66/170, 196, 197, 19, 22, 24; 442/181, 203, 304, 308, 312

(56) References Cited

U.S. PATENT DOCUMENTS 3,808,843 A * 5/1974 Blore et al. ..... 66/196
4,019,350 A * 4/1977 Schmidt ..... 66/196
4,229,954 A * 10/1980 Blore ..... 66/196
4,891,958 A * 1/1990 Cournoyer et al. ..... 66/196
4,941,331 A * 7/1990 Cournoyer et al. ..... 66/25
5,031,425 A * 7/1991 Cournoyer et al. ..... 66/198
5,267,454 A * 12/1993 Gregory ..... 66/196
6,164,095 A * 12/2000 Rock et al. ..... 66/194
6,321,574 B1 * 11/2001 Marker et al. ..... 66/19

* cited by examiner

*Primary Examiner*—Danny Worrell
(74) *Attorney, Agent, or Firm*—Galgano & Burke

(57) ABSTRACT

A double-faced reversible color effect fabric is produced on a double bed weft knitting machine with three yarn feeding systems. The first yarn feeder feeds yarn of a first color for the front of the fabric. The second yarn feeder feeds yarn of a second color for the rear of the fabric. The third yarn feeder, according to the invention, feeds a stretchable yarn which serves as an intermediate to interlock between the stitches formed on the front bed and the stitches formed on the rear bed. According to the presently preferred embodiment, the double-faced reversible color effect fabric is produced with a six step/six course knit and tuck knitting process whereby the produced fabric has no air pockets between fabric layers and has no visible tuck marks or mesh openings. The methods of the invention can be used to form a double-faced fabric with or without a motif.

22 Claims, 1 Drawing Sheet

DOUBLE-FACED REVERSIBLE COLOR EFFECT WEFT KNIT FABRICS AND METHODS FOR MAKING SAME

BACKGROUND OF THE INVENTION

1. Field of the Invention

The invention relates to weft knit fabrics and methods for producing them. More particularly, the invention relates to reversible color effect fabrics (i.e. fabrics having a different color on each side) and methods for making such fabrics on a double bed knotting machine.

2. State of the Art

Reversible color effect fabrics (i.e. fabrics having a different color on each side) have a variety of applications in clothing, accessories, and in various household products such as curtains, tablecloths, etc. The prior art suggests several methods of making reversible color effect fabrics.

According to one prior art method, two different color fabrics are bound to each other by sewing their edges together to form what appears to be a single fabric with different color sides. This method has many disadvantages. It uses twice as much material, requires cutting material twice, and additional sewing is required. All of these factors increase the cost of the material. In addition, an air space is created between the two layers of material. This results in practical and aesthetic disadvantages. The material may act as an insulator and clothing made with the material will make the wearer uncomfortable warm in warm weather. Aesthetically, the air space will allow the two layers of fabric to move relative to each other resulting in an untidy appearance.

Another prior art method of making a reversible color effect fabric is to bind two layers of fabric to each other with glue or a fusible interfacing. One of the disadvantages of this method is that the adhesive hardens during the binding process, giving the resulting fabric a stiff feel. Another disadvantage is that the adhesive dissolves after the fabric is washed several times and the layers begin to separate in random places.

Somewhat better prior art methods utilize a double bed knitting machine wherein two different color layers of fabric are made simultaneously, one on the front bed and the other on the rear bed. According to one of these methods, the two layers are bound to each other by cross knitted stitching at their edges. The advantage of this method is that the two layers do not need to be separately cut. However, there remains the air pocket between the layers.

Another method using a double bed knitting machine involves knitting a pattern on one bed while crossing over to tuck on the opposite bed. Depending on the nature of the pattern, the two layers are bound to each other along edges of the motives by tucking. A disadvantage of this method is that depending on the pattern, there may still exist air pockets between the two layers. In addition, tucking leaves visible marks on the surface of the fabric resulting in "cellular like mesh openings" or "quilting stitch patterns". This method may be optimized using a jacquard pattern where the motif is knitted with one color yarn and the background is knitted with another color yarn. However, there will still be openings and pockets between the motif and the background.

SUMMARY OF THE INVENTION

It is therefore an object of the invention to provide a method for producing a double-faced reversible color effect fabric which leaves no air pockets between layers of fabric.

It is also an object of the invention to provide a method for producing a double-faced reversible color effect fabric which does not have visible talk mark such as "cellular like mesh openings" or "quilting stitch patterns" which indicates binding of two fabric layers.

It is another object of the invention to provide a method for producing a double-faced reversible color effect fabric which is economical.

It is still another object of the invention to provide a double-faced reversible color effect fabric which does not have air pockets between layers of fabric.

It is yet another object of the invention to provide a double-faced reversible color effect fabric which does not have "cellular like mesh openings" or "quilting stitch patterns".

It is still another object of the invention to provide a double-faced reversible color effect fabric which is economical to produce.

In accord with these objects which will be discussed in detail below, the double-faced reversible color effect fabric of the present invention is produced on a double bed weft knitting machine with three yarn feeding systems. The first feeds yarn of a first color for the front of the fabric. The second yarn feeder feeds yarn of a second color for the rear of the fabric. The third yarn feeder, according to the invention feeds a stretchable yarn which serves as an intermediate to interlock between the stitches formed on the front bed and the stitches formed on the rear bed. According to the presently preferred embodiment, the double-faced reversible color effect fabric is produced with a six step/six course knit and tuck knitting process whereby the produced fabric has no air pockets between fabric layers and has no visible tuck marks or mesh openings. The methods of the invention can be used to form a double-faced fabric with or without a motif.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
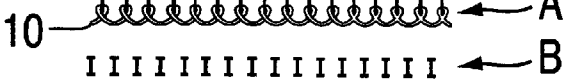
FIG. 1 is schematic diagram illustrating a first step/course according to a method of the invention.
Figure 2:
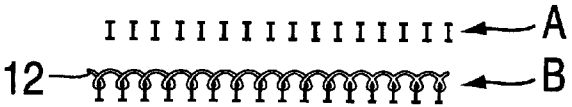
FIG. 2 is schematic diagram illustrating a second step/course according to a method of the invention.
Figure 3:
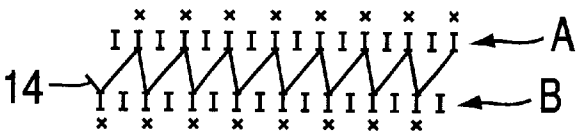
FIG. 3 is schematic diagram illustrating a third step/course according to a method of the invention.

Referring now to FIGS. 1 through 6, according to one of the Methods of the invention, using a double bed weft knitting machine, a first course is knitted using a first yarn 10 on every needle of a first bed A of the knitting machine as shown in FIG. 1. A second course is knitted using a second yarn 12 (preferably having a different color than the first yarn) on every needle of a second bed B of the knitting machine as shown in FIG. 2.

A third course is knitted with a third yarn 14 tucking on even numbered needles in bed A and odd numbered needles in bed B. According to the invention, the third yarn 14 is a stretchable yarn such as nylon/lycra. The third yarn is preferably of thinner density than the first two yarns and is of a third (neutral) color.

Figure 4:
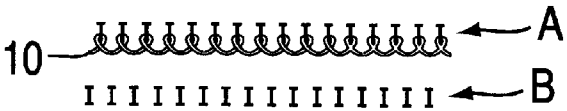
FIG. 4 is schematic diagram illustrating a fourth step/course according to a method of the invention.
Figure 5:
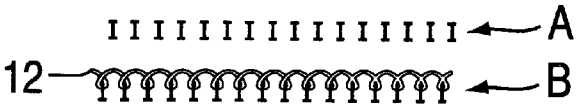
FIG. 5 is schematic diagram illustrating a fifth step/course according to a method of the invention.
Figure 6:
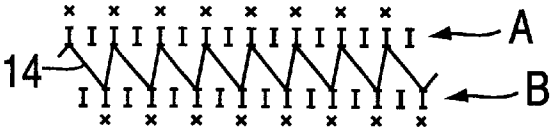
FIG. 6 is schematic diagram illustrating a sixth step/course according to a method of the invention.

The fourth course, shown in FIG. 4, is a repeat of the first course with the first yarn being knitted on every needle of bed A. Similarly, the fifth course, shown in FIG. 5, is a repeat of the second course with the second yarn being knitted on every needle of bed B.

The sixth and final course is similar to the third course in that the third yarn is used to tuck between the two beds. In this course, however, the third yarn 14 tucks on odd numbered needles in bed A and even numbered needles in bed B.

The above-described six course process results in a double-faced reversible color effect fabric which has no air pockets between fabric layers and has no visible tuck marks or mesh openings. The fabric may be described as having a fully stitched course on one side, followed by a fully stitched course on the Ether side, followed by an alternately stitched tucking course where tucking courses alternate between odd to even needles and even to odd needles. Thus, it will be appreciated that the steps of the invention, i.e. the courses shown in FIGS. 1–6, need not start with the course shown in FIG. 1. The process may begin with any of the six courses so long as the courses follow in the order shown. For example, the courses may begin with course 5 and continue with 6, 1, 2, 3, 4, etc.

From the foregoing, those skilled in the art will appreciate that the use of a stretchable yarn for the tucking courses is an important feature of the invention. The first and second yarns, however, may be virtually any kind of yarn. Preferably, the first and second yarns are substantially the same but for their color.

There have been described and illustrated herein several embodiments of a method for producing a double-faced reversible color effect fabric and a fabric made from the method. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A method of producing a double-faced weft knit fabric using a double bed knitting machine having a first bed of needles and a second bed of needles, said method comprising:

a) knitting a first course on substantially all of the needles in the first bed using a first yarn;

b) knitting a second course on substantially all of the needles in the second bed using a second yarn; and c) knitting a third course with a third yarn tucking on alternate needles in the first and second beds, wherein said third yarn is stretchable.

2. The method of claim 1, wherein:

the first yarn and the second yarn are different colors.

3. The method of claim 2, wherein:

the third yarn is a neutral color.

4. The method of claim 3, wherein:

the first and second yarn are contrasting colors.

5. The method of claim 1, wherein:

the third course is knitted on even needles in the first bed and on odd needles in the second bed.

6. The method of claim 5, further comprising:

d) repeating the first course as a fourth course;

e) repeating the second course as a fifth course; and f) knitting a sixth course with the third yarn tucking on odd needles in the first and even needles in the second bed.

7. The method of claim 6, wherein:

the first yarn and the second yarn are different colors.

8. The method of claim 7, wherein:

the third yarn is a neutral color.

9. The method of claim 8, wherein:

the first and second yarn are contrasting colors.

10. A fabric made according to the method of claim 1, said fabric having substantially no air pockets between fabric layers and substantially no visible tuck marks or mesh openings.

11. The fabric of claim 10 wherein:

the first yarn and the second yarn are different colors.

12. The fabric of claim 11, wherein:

the third yarn is a neutral color.

13. The fabric of claim 12, wherein:

the first and second yarn are contrasting colors.

14. A double-faced weft knit fabric comprising:

a) a substantially fully stitched first course on one face of the fabric;

b) a substantially fully stitched second course on the other face of the fabric; and c) an alternately stitched third course tucking between the two faces of the fabric, wherein the first course is made with a first yarn, the second course is made with a second yarn, and the third course is made with a third yarn which is stretchable.

15. The fabric of claim 14, wherein:

the first yarn and the second yarn are different colors.

16. The fabric of claim 15, wherein:

the third yarn is a neutral color.

17. The fabric of claim 16, wherein:

the first and second yarn are contrasting colors.

18. The fabric of claim 14, wherein:

the third course has even stitches on one face and odd stitches on the other face.

19. The fabric of claim 18, further comprising:

d) a fourth course substantially the same as the first course;

e) a fifth course substantially the same as the second course; and f) a sixth course having odd stitches on one face and even stitches on the other face.

20. The fabric of claim 19, wherein:

the first yarn and the second yarn are different colors.

21. The fabric of claim 20, wherein:

the third yarn is a neutral color.

22. The fabric of claim 21, wherein:

the first and second yarn are contrasting colors.

* * * * *